US011763622B2

(12) United States Patent
Geng

(10) Patent No.: US 11,763,622 B2
(45) Date of Patent: Sep. 19, 2023

(54) VENDING MACHINE FOR VENDING LUGGAGE

(71) Applicant: Xinsuo Group Co., Ltd., Jinhua (CN)

(72) Inventor: Hu Geng, Jinhua (CN)

( * ) Notice: Subject to any disclaimer, the term of this patent is extended or adjusted under 35 U.S.C. 154(b) by 451 days.

(21) Appl. No.: 16/880,958

(22) Filed: May 21, 2020

(65) Prior Publication Data

US 2020/0302729 A1 Sep. 24, 2020

(51) Int. Cl.

*G07F 11/00* (2006.01)
*G07F 11/46* (2006.01)
*G07F 17/00* (2006.01)

(52) U.S. Cl.

CPC ..... *G07F 11/007* (2013.01); *G07F 11/46* (2013.01); *G07F 17/005* (2013.01)

(58) Field of Classification Search

CPC ..... G07F 11/007; G07F 11/46; G07F 17/005; G07F 17/10

See application file for complete search history.

(56) References Cited

U.S. PATENT DOCUMENTS 5,253,782 A 10/1993 Gates et al.
2002/0087429 A1* 7/2002 Shuster ..... G07F 17/13 340/5.73

FOREIGN PATENT DOCUMENTS

CN 104802714 A * 7/2015
CN 206179092 U * 5/2017
CN 108898751 A * 11/2018

OTHER PUBLICATIONS

CN104802714A, Luggage rack with guardrail anti-theft device, English machine translation, 3 pages (Year: 2022).*
CN206179092U, Case and bag vending machine, English machine translation, 2 pages (Year: 2022).*
CN108898751A, Charging storage system for luggage, English machine translation, 5 pages (Year: 2022).*

* cited by examiner

*Primary Examiner* — Tuyen K Vo
(74) *Attorney, Agent, or Firm* — SANCHELIMA & ASSOCIATES, P.A.; Christian Sanchelima; Jesus Sanchelima

(57) ABSTRACT

This application discloses a luggage vending machine, including a shelf, a communication controller and an electronic lock, the communication controller and the electronic lock are both installed on the shelf, and the communication controller and the electronic lock are electrically connected, the communication controller is used for Communicate and control the opening and closing of electronic locks used to lock luggage. The utility model has the following beneficial effects: by installing an electronic lock and a communication controller on the shelf, the electronic lock is used to lock the suitcase on the shelf, and at the same time, the communication controller is further used to control the opening and closing of the electronic lock. The automatic sale of luggage is convenient and fast.

14 Claims, 5 Drawing Sheets

VENDING MACHINE FOR VENDING LUGGAGE

BACKGROUND OF THE INVENTION

1. Other Related Applications

The present application is a U.S. Non-Provisional Patent Applications claiming priority of International Chinese Patent Application Serial No 209543469 filed on Mar. 21, 2019, which is hereby incorporated by reference.

2. Field of the Invention

The present invention relates to the field of automatic vending machines, in particular to a suitcase automatic vending machine.

3. Description of the Related Art

Luggage is a tool we often use. In actual life, we often encounter the phenomenon of urgent need for luggage. People currently buy suitcases from stores or e-commerce, but the current stores are not open 24 hours. It takes longer for e-commerce customers to place orders and get suitcases, so this leads to an extremely embarrassing phenomenon in life, that is, the problem of not being able to buy a bag when it is urgently needed.

In response to the above problems, the utility model proposes a luggage vending machine.

The technical scheme adopted by the utility model is as follows: A luggage vending machine includes a shelf, a communication controller and an electronic lock, the communication controller and the electronic locks are all installed on the shelf, and the communication controller is electrically connected with the electronic lock. The communication controller is used to communicate and control the opening and closing of the electronic lock. The electronic lock is used to lock the luggage.

In this device, when the suitcase is locked by an electronic lock, the suitcase cannot be taken off the shelf. When the communication controller receives the signal, the electronic lock is opened, so that the electronic lock no longer locks the suitcase, so that Remove the suitcase from the shelf.

The device is equipped with an electronic lock and a communication controller on the shelf. The electronic lock is used to lock the luggage on the shelf. At the same time, the communication controller is further used to control the opening and closing of the electronic lock, which is convenient and fast, and realizes the automatic sale of luggage, Convenient.

Optionally, a plate is provided on the shelf, and the plate is used to hold a suitcase.

Optionally, the electronic lock includes a lock body and a lock piece, and the lock body and the lock piece are directly or indirectly set on the shelf; when the lock body and the lock piece cooperate together and the luggage rod is located on the lock body to the lock Between the pieces, the lock body and the pieces lock the luggage on the shelf.

Optionally, the shelf is provided with a locking plate, and the lock body and the locking piece are both arranged on the locking plate.

Optionally, the locking plate is fixed with a mounting support, one end of the locking plate is rotatably matched with the mounting support, and the other end of the locking plate is used to cooperate with a lock tongue in the lock body, the lock body It is electrically connected with the communication controller, which is used to control the working state of the lock tongue of the lock body.

Optionally, the shelf is a metal shelf.

The beneficial effects of the utility model are: by installing an electronic lock and a communication controller on the shelf, the electronic lock is used to lock the suitcase on the shelf, and at the same time, the communication controller is further used to control the opening and closing of the electronic lock, which is convenient and fast The automatic sale of luggage is convenient and fast.

Several designs of vending machines are disclosed in the past that allows to dispense goods such as snacks, beverages, cigarettes, lottery tickets and so on. One such example is disclosed in a U.S. Pat. No. 5,253,782. In U.S. Pat. No. 5,253,782A, it is disclosed that—an article dispensing apparatus that comprises a frame having a protective housing mounted thereon and a rotatable turret having a plurality of vertical channels circumferentially arranged about the axis of the turret, each channel holding a stack of articles. Although the vending machine discussed above is capable of dispensing variety of goods, none of them discloses dispensing or allowing a customer for picking trolley bags contained therein. The present invention addresses this issue by providing an easy to use automated device that allows a user to personally select and easily pay for a luggage of their choice.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a vending machine for picking a trolley bag in response to a customer selection and tendering payment for the luggage bag and that avoids the drawbacks of the prior art.

It is another object of this invention to provide a vending machine that can be deployed in a retail store or any building for automatically dispensing luggage bags contained therein based on the selection of a customer.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
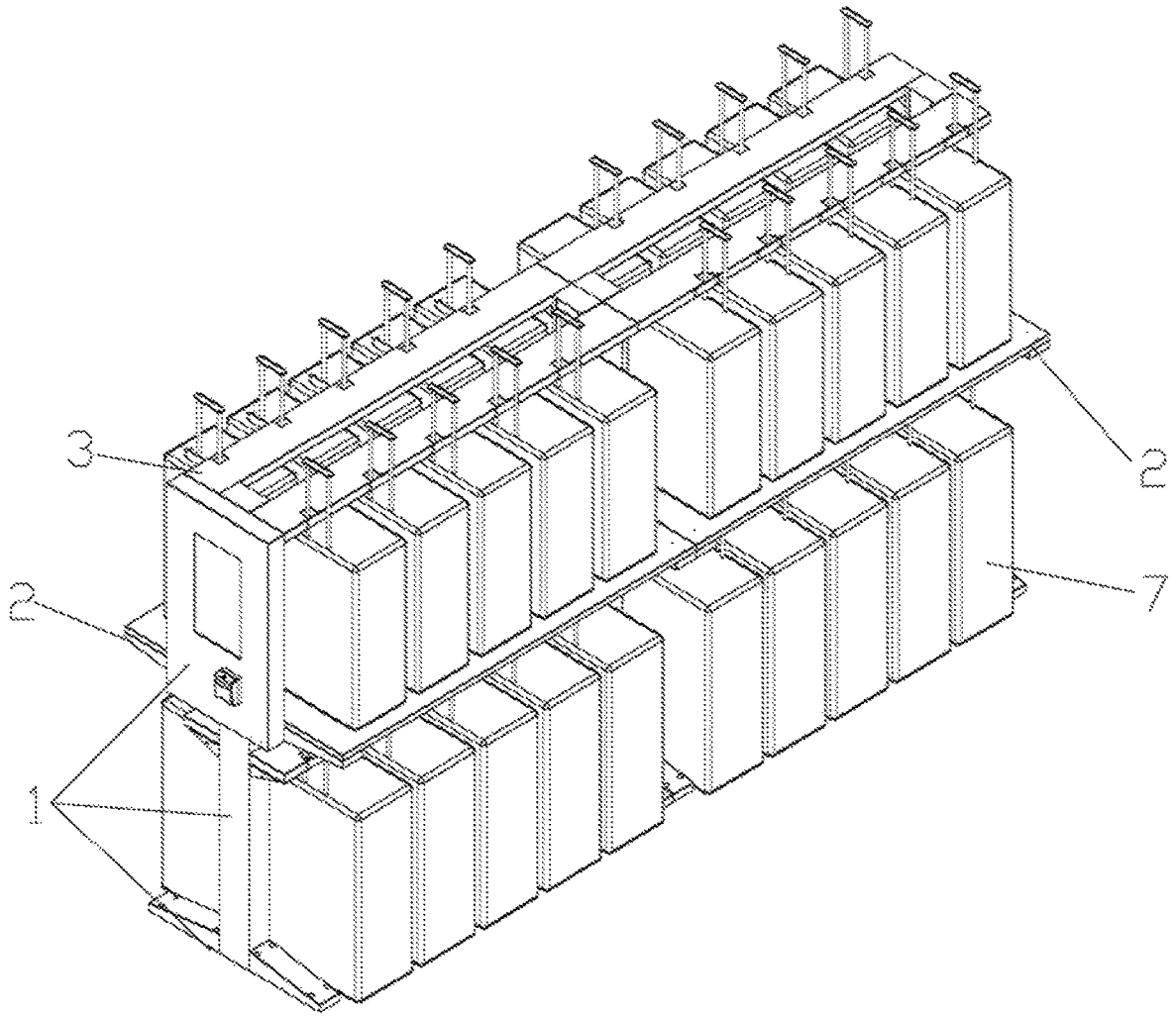
FIG. 1 is a schematic diagram of the structure of Example 1.

The utility model will be described in detail below with reference to the accompanying drawings.

Example 1

As shown in FIG. 1, FIG. 2, FIG. 3 and FIG. 4, a luggage vending machine includes a shelf 1, a communication controller and an electronic lock, and the communication controller and the electronic lock are installed on the shelf 1 And, the communication controller is electrically connected with the electronic lock, the communication controller is used for communication and controlling the opening and closing of the electronic lock, and the electronic lock is used to lock the luggage 7.

In this device, when the luggage compartment 7 is locked by an electronic lock, the luggage compartment 7 cannot be removed from the shelf 1. When the communication controller receives the signal, the electronic lock is opened so that the electronic lock no longer locks the luggage compartment 7 So that the luggage 7 can be removed from the shelf 1.

The device is equipped with an electronic lock and a communication controller on the shelf 1, the electronic lock is used to lock the luggage 7 on the shelf 1, and the communication controller is further used to control the opening and closing of the electronic lock, which is convenient and fast, and realizes the luggage 7 automatic sales, convenient and fast.

As shown in FIG. 1, FIG. 2, FIG. 3, and FIG. 4, the shelf 1 is provided with a flat plate 2, and the flat plate 2 is used to hold a luggage case 7.

As shown in FIG. 1, FIG. 2, FIG. 3, and FIG. 4, the electronic lock includes a lock body 4 and a lock plate 6, and the lock body 4 and the lock plate 6 are directly or indirectly disposed on the shelf 1; when the lock body 4 When the lock piece 6 is fitted together and the pull rod 7 of the luggage case 7 is located between the lock body 4 and the lock piece 6, the lock body 4 and the lock piece 6 lock the luggage case 7 on the shelf 1.

As shown in FIG. 1, FIG. 2, FIG. 3 and FIG. 4, the rack 1 is provided with a lock plate 3, and the lock body 4 and the lock piece 6 are both provided on the lock plate 3.

As shown in FIG. 1, FIG. 2, FIG. 3, and FIG. 4, the mounting plate 3 is fixed with a mounting support 5, one end of the locking plate 6 rotates with the mounting support 5, and the other end of the locking plate 6 is used In cooperation with the lock tongue 402 in the lock body 4, the lock body 4 is electrically connected with the communication controller, and the communication controller is used to control the working state of the lock tongue 402 of the lock body 4.

As shown in FIG. 1, FIG. 2, FIG. 3 and FIG. 4, the shelf 1 is a metal shelf 1.

Figure 2:
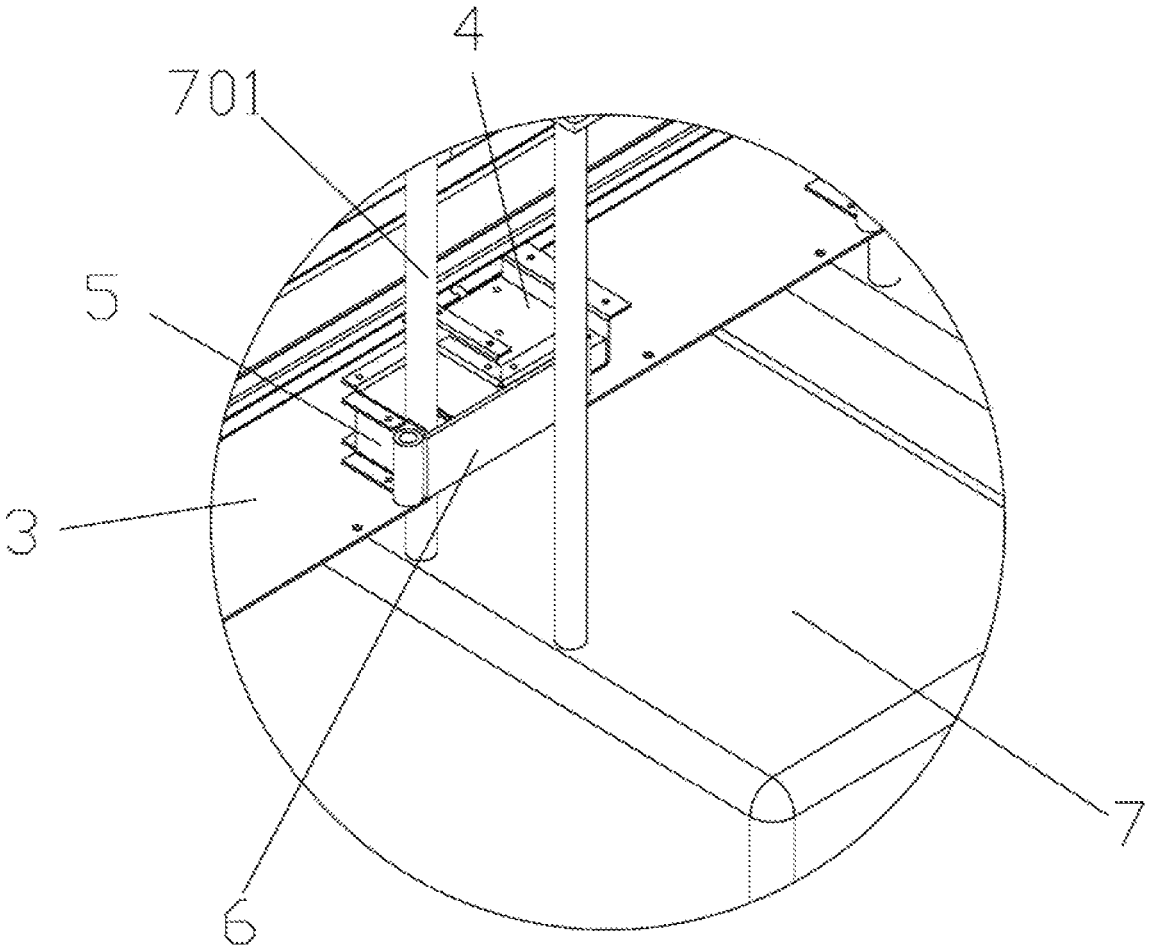
FIG. 2 is a schematic structural view of an electromagnetic lock when locking a luggage case in Embodiment 1.
Figure 3:
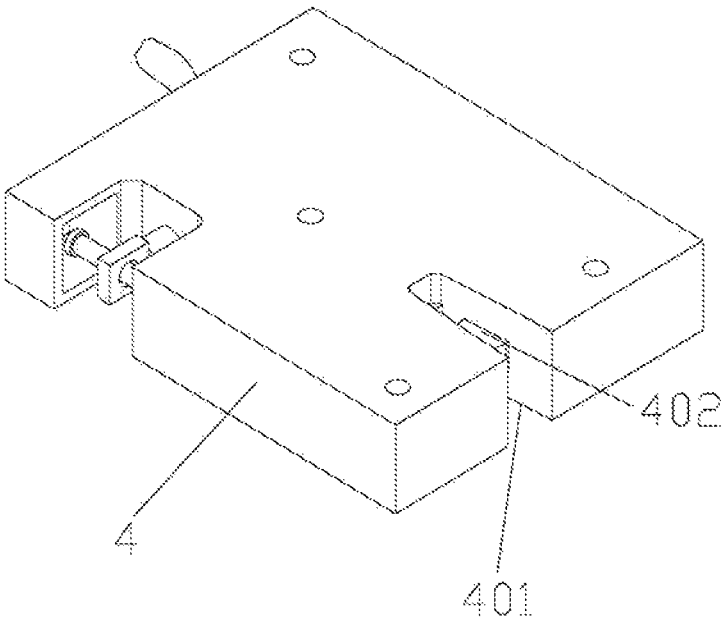
FIG. 3 is a schematic diagram of the structure of the lock body in Embodiment 1.
Figure 4:
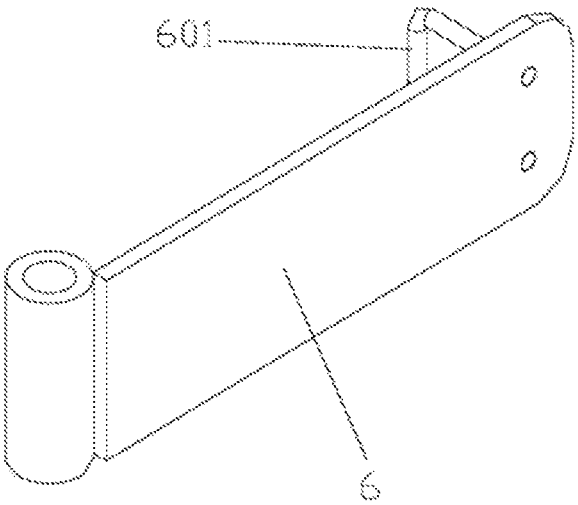
FIG. 4 is a schematic diagram of the structure of the lock piece in the embodiment 1.

As shown in FIG. 2, FIG. 3 and FIG. 4, the lock body 4 is provided with a lock slot 401, and a lock tongue 402 is provided in the lock slot 401. The buckle 601 on the locking plate 6 is used to cooperate with the locking tongue 402 in the locking groove 401, the mounting support 5 is fixed on the locking plate 3, and one end of the locking plate 6 is rotationally installed on the mounting support 5.

As shown in FIG. 1 and FIG. 2, the lock body 4 and the locking piece 6 are locked by the lever 701 of the luggage case 7.

Example 2

Figure 5:
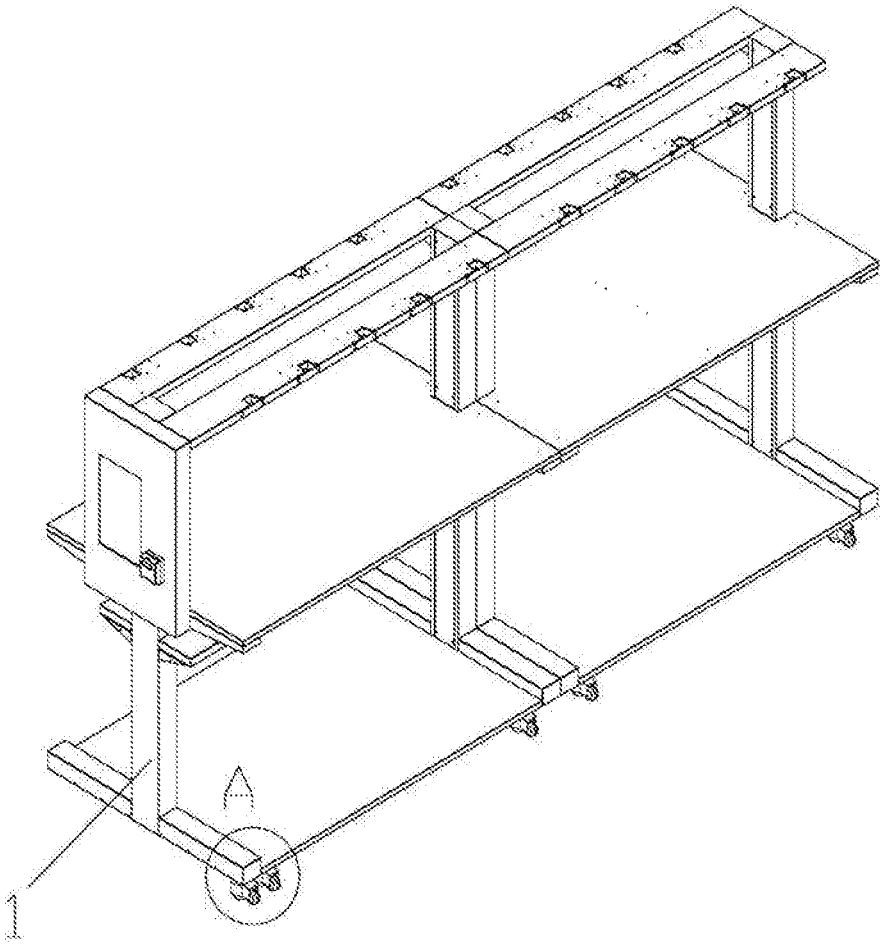
FIG. 5 is a schematic diagram of the structure of Example 2.
Figure 6:
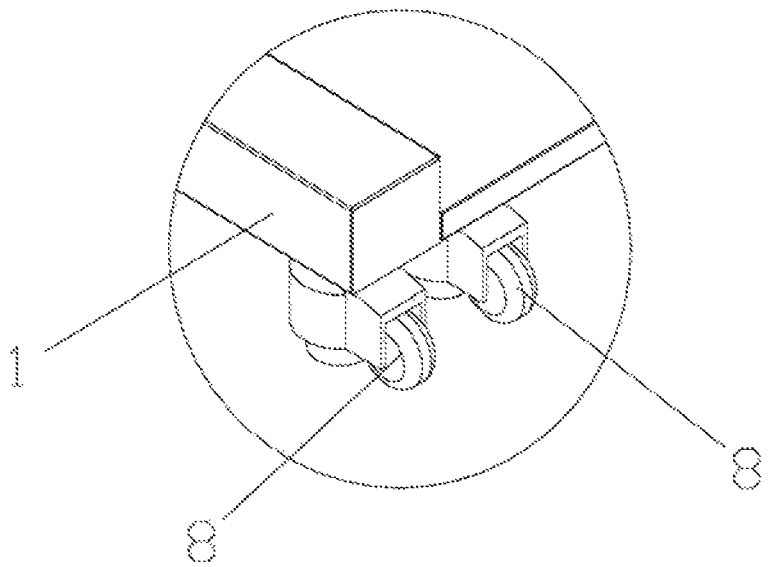
FIG. 6 is an enlarged schematic diagram of the structure at A in FIG. 5.

As shown in FIG. 5 and FIG. 6, in this embodiment, wheels 8 are installed on the shelf 1 in Embodiment 1, which facilitates the movement of the shelf 1. The structure and installation method of the electronic lock in this embodiment are the same as those in Embodiment 1. In this embodiment, the lock body 4 and the lock piece 6 are also locked by the lever 701 of the luggage box 7 to lock the luggage box 7 The same as in Example 1.

The above is only the preferred embodiment of the utility model, and does not limit the patent protection scope of the utility model. Any equivalent structural transformations made by using the specification and drawings of the utility model are directly or indirectly used in other related In the technical field, the same reason is included in the protection scope of the present invention.

What is claimed is:

1. A luggage vending machine, comprising:

a) a shelf, a communication controller and an electronic lock, the communication controller and the electronic lock are both installed on the shelf, and the communication controller is electrically connected to the electronic lock; the controller is used to communicate and control the opening and closing of the electronic lock, which is used to lock a luggage, said shelf having a bottom segment and an upper segment separated by a flat plate, said bottom segment having a flat surface which is rectangular-shaped horizontally disposed configured to receive at least one of said luggage, said flat plate having a rectangular shape as to receive at least one of said luggage thereupon, said controller and electronic lock are disposed on a front portion of the shelf, at an uppermost end said shelf has a lock plate that spans an entire width of said shelf, said front portion is located therebetween said lock plate and said flat plate, at a center portion the shelf has a cuboid pillar which separates the shelf into two symmetrical halves.

2. The luggage vending machine according to claim 1, characterized in that the electronic lock includes a lock body and a lock piece, and the lock body and the lock piece are directly or indirectly provided on the shelf; when the lock body and the lock piece are fitted together and a drawbar of the luggage is located between the lock body and the lock piece, the lock body and the lock piece lock the luggage on the shelf, said lock body having a rectangular shape with a lock slot at a lateral side thereof.

3. The luggage vending machine according to claim 2, wherein the lock body and the lock piece are both provided on the lock plate.

4. The luggage vending machine of claim 2, wherein multiple of said lock body and said lock piece are disposed at a periphery of said lock plate and are evenly spaced.

5. The luggage vending machine according to claim 3, characterized in that the lock piece is fixed with a mounting support, said lock piece has a cylindrical distal end which is operatively connected to a distal end of the mounting support, thereby permitting said lock piece to rotate about said cylindrical distal end, the lock body is attached at an opposite distal end of said mounting support, at an opposite distal end of said lock piece there is a buckle that extends orthogonally therefrom, said buckle is received and secured by a lock tongue of the lock body, wherein said lock tongue is disposed within said lock slot, the lock body is electrically connected with the communication controller, and the communication controller is used to control the working state of the lock tongue of the lock body.

6. The luggage vending machine of claim 5 wherein said mounting support has an opening configured to receive said drawbar therein, said lock piece by means of said lock body permits to secure and/or unluck said drawbar.

7. The luggage vending machine of claim 5 wherein said lock slot is volumetrically suitable to receive said buckle therein.

8. The luggage vending machine according to claim 1, wherein the shelf is a metal shelf.

9. The luggage vending machine according to claim 1, further comprising wheels, the wheels are mounted on the bottom segment of the shelf opposite to said flat surface, and the shelf is moved by the wheels.

10. The luggage bending machine of claim 1, wherein said lock plate has a central aperture.

11. The luggage bending machine of claim 1, wherein said front portion has a rectangular shape, said communication controller is centrally disposed thereon said front portion.

12. The luggage vending machine of claim 1, wherein said shelf has a first support member located at a front distal end of said flat surface, a second support member at a middle end of said flat surface and at a rear end of said flat surface, wherein said second support member is operatively connected to said cuboid pillar.

13. A luggage vending machine, comprising:

a) a shelf, a communication controller installed on the shelf, and the communication controller is electrically connected to an electronic lock; the controller is used to communicate and control the opening and closing of the electronic lock, which is used to lock a luggage, said shelf having a bottom segment and an upper segment separated by a flat plate, said bottom segment having a flat surface which is rectangular-shaped horizontally disposed configured to receive at least one of said luggage, said flat plate having a rectangular shape as to receive at least one of said luggage thereupon, said controller and electronic lock are disposed on a front portion of the shelf, at an uppermost end said shelf has a lock plate that spans an entire width of said shelf, said front portion is located therebetween said lock plate and said flat plate, at a center portion the shelf has a cuboid pillar which separates the shelf into two symmetrical halves;

b) the electronic lock having a lock body and a lock piece secured to said lock plate by means of a mounting support, said lock piece has a first distal end with a cylinder formed thereat, wherein said first distal end of said lock piece is operatively attached to a distal end of the mounting support thereby permitting said lock piece to rotate about said first distal end, said lock body is attached to an opposite distal end of the mounting support, said mounting support having an opening that receives a drawbar of said luggage therein, the lock body is electrically connected with the communication controller, and the communication controller is used to control the working state of a lock tongue of the lock body, said lock tongue engages a buckle of said lock piece.

14. A luggage vending machine, consisting of:

a) a shelf made of metal, a communication controller installed on the shelf, the communication controller is electrically connected to an electronic lock; the controller is used to communicate and control the opening and closing of the electronic lock, which is used to lock a luggage, said shelf having a bottom segment and an upper segment separated by a flat plate, said bottom segment having a flat surface which is rectangular-shaped horizontally disposed configured to receive at least one of said luggage, said flat plate having a rectangular shape as to receive at least one of said luggage thereupon, said controller and electronic lock are disposed on a front portion of the shelf, at an uppermost end said shelf has a lock plate that spans an entire width of said shelf, said front portion is located therebetween said lock plate and said flat plate, at a center portion the shelf has a cuboid pillar which separates the shelf into two symmetrical halves;

b) the electronic lock having a lock body and a lock piece secured to said lock plate by means of a mounting support, said lock piece has a first distal end with a cylinder formed thereat, wherein said first distal end of said lock piece is operatively attached to a distal end of the mounting support thereby permitting said lock piece to rotate about said first distal end, said lock body is attached to an opposite distal end of the mounting support, said mounting support has an opening configured to receive a drawbar therein, said lock piece by means of said lock body permits to secure and/or unluck said drawbar, the lock body is electrically connected with the communication controller, and the communication controller is used to control the working state of a lock tongue of the lock body, said lock tongue engages a buckle of said lock piece, multiple of said lock body and said lock piece are disposed at a periphery of said lock plate and are evenly spaced.

* * * * *